US006234547B1

(12) United States Patent
Ruffino

(10) Patent No.: US 6,234,547 B1
(45) Date of Patent: May 22, 2001

(54) MULTIFUNCTION DOOR KNOB ASSEMBLY

(76) Inventor: Anthony C. Ruffino, 20 Greenfield Ct., Staten Island, NY (US) 10304

( * ) Notice: Subject to any disclaimer, the term of this patent is extended or adjusted under 35 U.S.C. 154(b) by 0 days.

(21) Appl. No.: 09/388,958

(22) Filed: Sep. 2, 1999

(51) Int. Cl.[7] ..... E05C 19/00
(52) U.S. Cl. ..... 292/252; 292/336.3
(58) Field of Search ..... 292/252, 336.3

(56) References Cited

U.S. PATENT DOCUMENTS

| | | | | |
|---|---|---|---|---|
| D. 249,120 | * | 8/1978 | Jerila | D8/341 |
| 2,070,149 | * | 2/1937 | Turner | 292/252 |
| 2,621,954 | * | 12/1952 | Buck | 292/252 |
| 2,832,623 | * | 4/1958 | Goleman | 292/252 |
| 3,975,933 | * | 8/1976 | Bako | 70/70 |
| 4,003,593 | * | 1/1977 | Wilzig et al. | 292/92 |
| 4,007,954 | * | 2/1977 | Erickson | 292/165 |
| 4,629,228 | * | 12/1986 | Marko et al. | 292/165 |
| 4,986,583 | * | 1/1991 | Campbell et al. | 292/336.3 |

FOREIGN PATENT DOCUMENTS

| | | | | |
|---|---|---|---|---|
| 433474 | * | 4/1948 | (IT) | 292/252 |
| 47801 | * | 4/1930 | (NO) | 292/252 |

* cited by examiner

*Primary Examiner*—Teri Pham Luu

(57) ABSTRACT

A multifunction door knob assembly for allowing for a door to be opened easily without being forced to turn a door knob. The inventive device includes an engagement mechanism is disposed within the side opening of the door. The engagement mechanism includes a cylindrical casing having open opposed ends. One of the opposed ends has a ball bearing slidably disposed therein. The ball bearing engages a door casing in a closed orientation. Opposed from the ball bearing in the opposed open end of the casing is a pressure block. The pressure block is slidably disposed within the casing. The pressure block has a pair of tabs disposed thereon to preclude disengagement from the casing. A spring is disposed between interior ends of the ball bearing and the pressure block. A swing arm is disposed within the side opening of the door inwardly of the engagement mechanism. The swing arm has an outer portion and an inner portion. An inner end of the inner portion is pivotally coupled within the side opening of the door. An outer end of the outer portion has a roller ball disposed therein within a U-shaped housing. The roller ball selectively engages an inner end of the pressure block. The inner portion is freely rotatable with respect to the outer portion. The inner portion has a coil spring coupled thereto to facilitate retractable rotation of the inner portion. The inner portion has a cord wrappedly coupled thereto.

4 Claims, 4 Drawing Sheets

MULTIFUNCTION DOOR KNOB ASSEMBLY

BACKGROUND OF THE INVENTION

1. Field of the Invention

The present invention relates to door latches and more particularly pertains to a new multifunction door knob assembly for allowing for a door to be opened easily without being forced to turn a door knob.

2. Description of the Prior Art

The use of door latches is known in the prior art. More specifically, door latches heretofore devised and utilized are known to consist basically of familiar, expected and obvious structural configurations, notwithstanding the myriad of designs encompassed by the crowded prior art which have been developed for the fulfillment of countless objectives and requirements.

Known prior art door latches include U.S. Pat. No. 4,629,228 to Marko et al.; U.S. Pat. No. 4,986,583 to Campbell et al.; U.S. Pat. No. Des. 249,120 to Jerila; U.S. Pat. No. 4,007,954 to Erickson; U.S. Pat. No. 3,975,933 to Bako; and U.S. Pat. No. 4,003,593 to Wilzig et al.

While these devices fulfill their respective, particular objectives and requirements, the aforementioned patents do not disclose a new multifunction door knob assembly. The inventive device includes an engagement mechanism is disposed within the side opening of the door. The engagement mechanism includes a cylindrical casing having open opposed ends. One of the opposed ends has a ball bearing slidably disposed therein. The ball bearing engages a door casing in a closed orientation. Opposed from the ball bearing in the opposed open end of the casing is a pressure block. The pressure block is slidably disposed within the casing. The pressure block has a pair of tabs disposed thereon to preclude disengagement from the casing. A spring is disposed between interior ends of the ball bearing and the pressure block. A swing arm is disposed within the side opening of the door inwardly of the engagement mechanism. The swing arm has an outer portion and an inner portion. An inner end of the inner portion is pivotally coupled within the side opening of the door. An outer end of the outer portion has a roller ball disposed therein within a U-shaped housing. The roller ball selectively engages an inner end of the pressure block. The inner portion is freely rotatable with respect to the outer portion. The inner portion has a coil spring coupled thereto to facilitate retractable rotation of the inner portion. The inner portion has a cord wrappedly coupled thereto.

In these respects, the multifunction door knob assembly according to the present invention substantially departs from the conventional concepts and designs of the prior art, and in so doing provides an apparatus primarily developed for the purpose of allowing for a door to be opened easily without being forced to turn a door knob.

SUMMARY OF THE INVENTION

In view of the foregoing disadvantages inherent in the known types of door latches now present in the prior art, the present invention provides a new multifunction door knob assembly construction wherein the same can be utilized for allowing for a door to be opened easily without being forced to turn a door knob.

The general purpose of the present invention, which will be described subsequently in greater detail, is to provide a new multifunction door knob assembly apparatus and method which has many of the advantages of the door latches mentioned heretofore and many novel features that result in a new multifunction door knob assembly which is not anticipated, rendered obvious, suggested, or even implied by any of the prior art door latches, either alone or in any combination thereof.

To attain this, the present invention generally comprises a door having a side opening extending within a side edge thereof. The door has openings through front and rear surfaces thereof in communication with the side opening. An engagement mechanism is disposed within the side opening of the door. The engagement mechanism includes a cylindrical casing having open opposed ends. One of the opposed ends has a ball bearing slidably disposed therein. The ball bearing engages a door casing in a closed orientation. Opposed from the ball bearing in the opposed open end of the casing is a pressure block. The pressure block is slidably disposed within the casing. The pressure block has a pair of tabs disposed thereon to preclude disengagement from the casing. A spring is disposed between interior ends of the ball bearing and the pressure block. A swing arm is disposed within the side opening of the door inwardly of the engagement mechanism. The swing arm has an outer portion and an inner portion- An inner end of the inner portion is pivotally coupled within the side opening of the door. An outer end of the outer portion has a roller ball disposed therein within a U-shaped housing. The roller ball selectively engages an inner end of the pressure block. The inner portion is freely rotatable with respect to the outer portion. The inner portion has a coil spring coupled thereto to facilitate retractable rotation of the inner portion. The inner portion has a cord wrappedly coupled thereto. A first door knob is slidably received within the opening in the front surface of the door. The first door knob has an interior arm portion disposed within the side opening of the door. The interior arm portion is positioned for selectively moving the swing arm forwardly when the first door knob is pushed inwardly with respect to the opening in the front surface of the door. A second door knob is removably positioned within the opening in the rear surface of the door. The second door knob is secured to a free end of the cord whereby outward pulling of the second door knob will pull the swing arm towards the opening in the rear surface of the door whereby releasing the second door knob will cause the coil spring to wind the cord around the spring arm and return the second door knob within the opening in the rear surface of the door. The second door knob has a stop block extending inwardly therefrom to limit movement of the swing arm.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new multifunction door knob assembly apparatus and method which has many of the advantages of the door latches mentioned heretofore and many novel features that result in a new multifunction door knob assembly which is not anticipated, rendered obvious, suggested, or even implied by any of the prior art door latches, either alone or in any combination thereof.

It is another object of the present invention to provide a new multifunction door knob assembly which may be easily and efficiently manufactured and marketed.

It is a further object of the present invention to provide a new multifunction door knob assembly which is of a durable and reliable construction.

An even further object of the present invention is to provide a new multifunction door knob assembly which is susceptible of a low cost of manufacture with regard to both materials and labor, and which accordingly is then susceptible of low prices of sale to the consuming public, thereby making such multifunction door knob assembly economically available to the buying public.

Still yet another object of the present invention is to provide a new multifunction door knob assembly which provides in the apparatuses and methods of the prior art some of the advantages thereof, while simultaneously overcoming some of the disadvantages normally associated therewith.

Still another object of the present invention is to provide a new multifunction door knob assembly for allowing for a door to be opened easily without being forced to turn a door knob.

Yet another object of the present invention is to provide a new multifunction door knob assembly which includes an engagement mechanism is disposed within the side opening of the door. The engagement mechanism includes a cylindrical casing having open opposed ends. One of the opposed ends has a ball bearing slidably disposed therein. The ball bearing engages a door casing in a closed orientation. Opposed from the ball bearing in the opposed open end of the casing is a pressure block. The pressure block is slidably disposed within the casing. The pressure block has a pair of tabs disposed thereon to preclude disengagement from the casing. A spring is disposed between interior ends of the ball bearing and the pressure block. A swing arm is disposed within the side opening of the door inwardly of the engagement mechanism. The swing arm has an outer portion and an inner portion. An inner end of the inner portion is pivotally coupled within the side opening of the door. An outer end of the outer portion has a roller ball disposed therein within a U-shaped housing. The roller ball selectively engages an inner end of the pressure block. The inner portion is freely rotatable with respect to the outer portion. The inner portion has a coil spring coupled thereto to facilitate retractable rotation of the inner portion. The inner portion has a cord wrappedly coupled thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
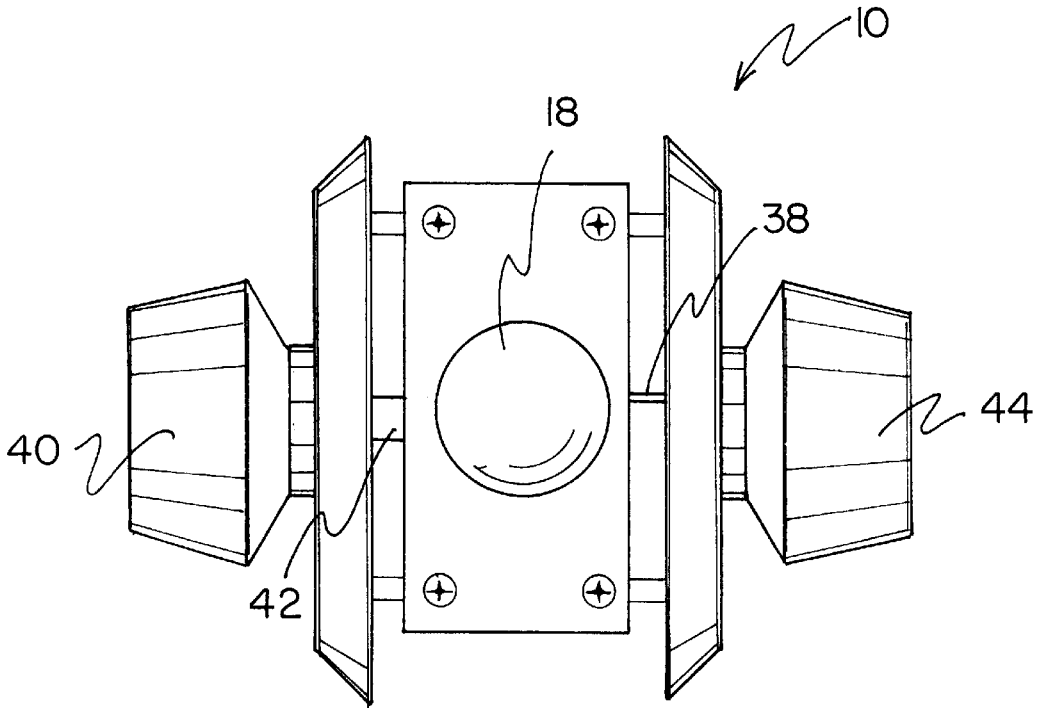
FIG. 1 is a side view of a new multifunction door knob assembly according to the present invention.
Figure 2:
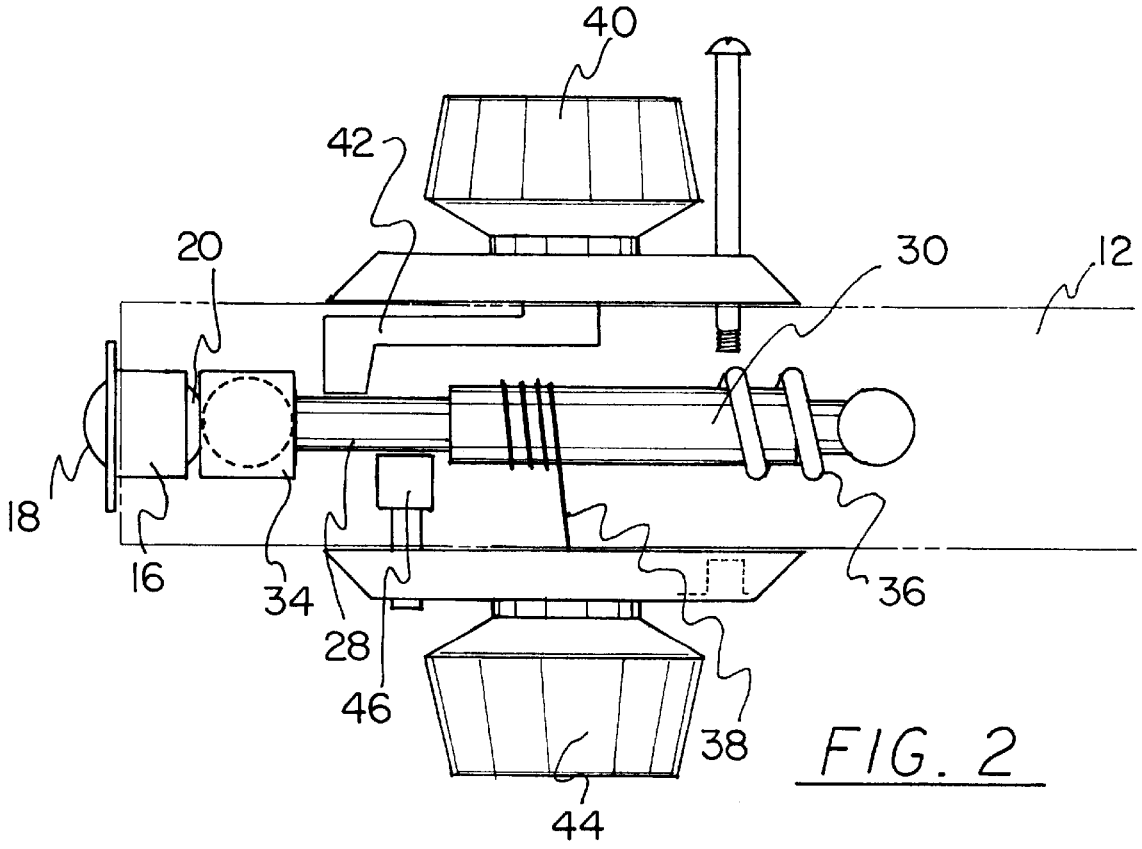
FIG. 2 is a top plan view of the present invention illustrated in use.
Figure 3:
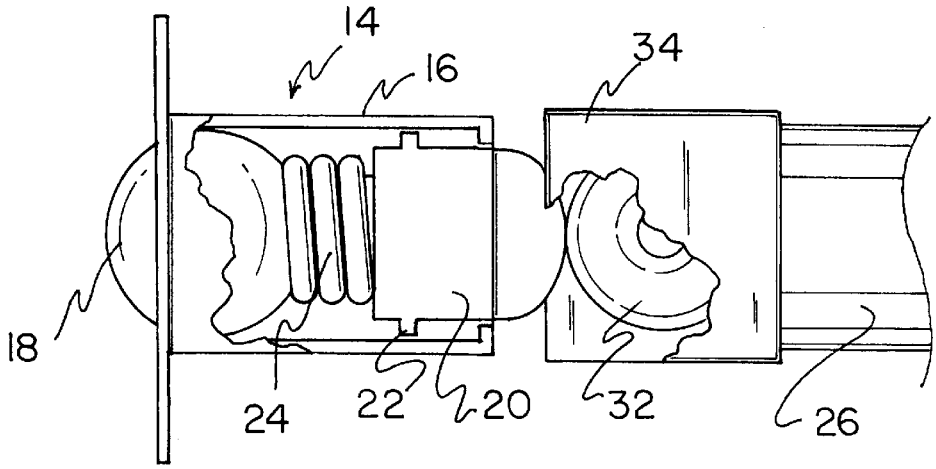
FIG. 3 is a breakaway view of the cylinder of the present invention illustrating the ball-bearing and pressure block as engaged to the swing arm.
Figure 4:
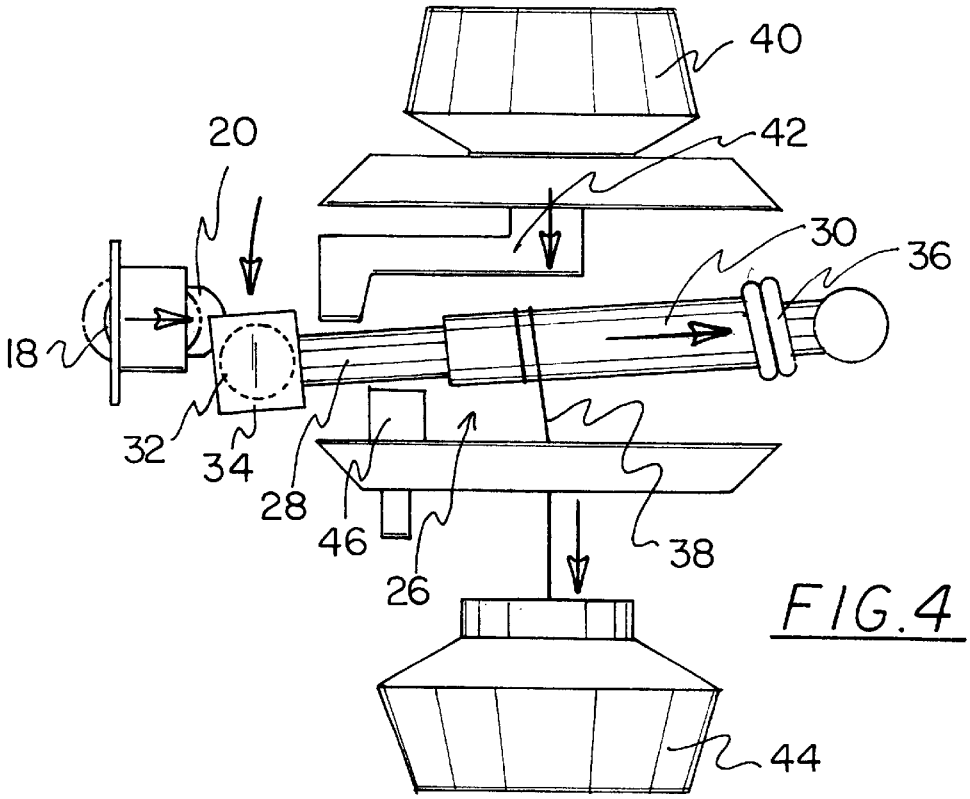
FIG. 4 is a plan view of the present invention illustrated in a disengaged orientation.

With reference now to the drawings, and in particular to FIGS. 1 through 7 thereof, a new multifunction door knob assembly embodying the principles and concepts of the present invention and generally designated by the reference numeral 10 will be described.

As best illustrated in FIGS. 1 through 4, the multifunction door knob assembly 10 comprises a door 12 having a side opening extending within a side edge thereof. The door 12 has openings through front and rear surfaces thereof in communication with the side opening.

An engagement mechanism 14 is disposed within the side opening of the door 12. The engagement mechanism 14 includes a cylindrical casing 16 having open opposed ends. One of the opposed ends has a ball bearing 18 slidably disposed therein. The ball bearing 18 engages a door casing in a closed orientation. Opposed from the ball bearing 18 in the opposed open end of the casing 16 is a pressure block 20. The pressure block 20 is slidably disposed within the casing 16. The pressure block 20 has a pair of tabs 22 disposed thereon to preclude disengagement from the casing 16. A spring 24 is disposed between interior ends of the ball bearing 18 and the pressure block 20.

A swing arm 26 is disposed within the side opening of the door 12 inwardly of the engagement mechanism 14. The swing arm 26 has an outer portion 28 and an inner portion 30. An inner end of the inner portion 30 is pivotally coupled within the side opening of the door 12. An outer end of the outer portion 28 has a roller ball 32 disposed therein within a U-shaped housing 34. The roller ball 32 selectively engages an inner end of the pressure block 20. The inner portion 30 is freely rotatable with respect to the outer portion 28. The inner portion 30 has a coil spring 36 coupled thereto to facilitate retractable rotation of the inner portion 30. The inner portion 30 has a cord 38 wrappedly coupled thereto.

A first door knob 40 is slidably received within the opening in the front surface of the door 12. The first door knob 40 has an interior arm portion 42 disposed within the side opening of the door 12. The interior arm portion 42 is positioned for selectively moving the swing arm 26 forwardly when the first door knob 40 is pushed inwardly with respect to the opening in the front surface of the door 12.

A second door knob 44 is removably positioned within the opening in the rear surface of the door 12. The second door knob 44 is secured to a free end of the cord 38 whereby outward pulling of the second door knob 44 will pull the swing arm 26 towards the opening in the rear surface of the door 12 whereby releasing the second door knob 44 will cause the coil spring 36 to wind the cord 38 around the spring arm 26 and return the second door knob 44 within the opening in the rear surface of the door 12. The second door knob 44 has a stop block 46 extending inwardly therefrom to limit movement of the swing arm 26.

In use, the swing arm 26 is capable of pivoting in either of two directions. When the centerline or axis of the swing arm 26 was in line with the axis of the cylindrical casing 16, the roller ball 32 of the swing arm 26 would force the pressure block 20 to compress the spring 24, thus forcing the ball bearing 18 into the door casing, either by pushing on the first door knob 40 or by pulling on the second door knob 44, the pressure block 20 would move back toward the center of the assembly. This would release tension on the spring 24, thus allowing the ball bearing 18 to also move back and allowing the door to be opened.

Figure 5:
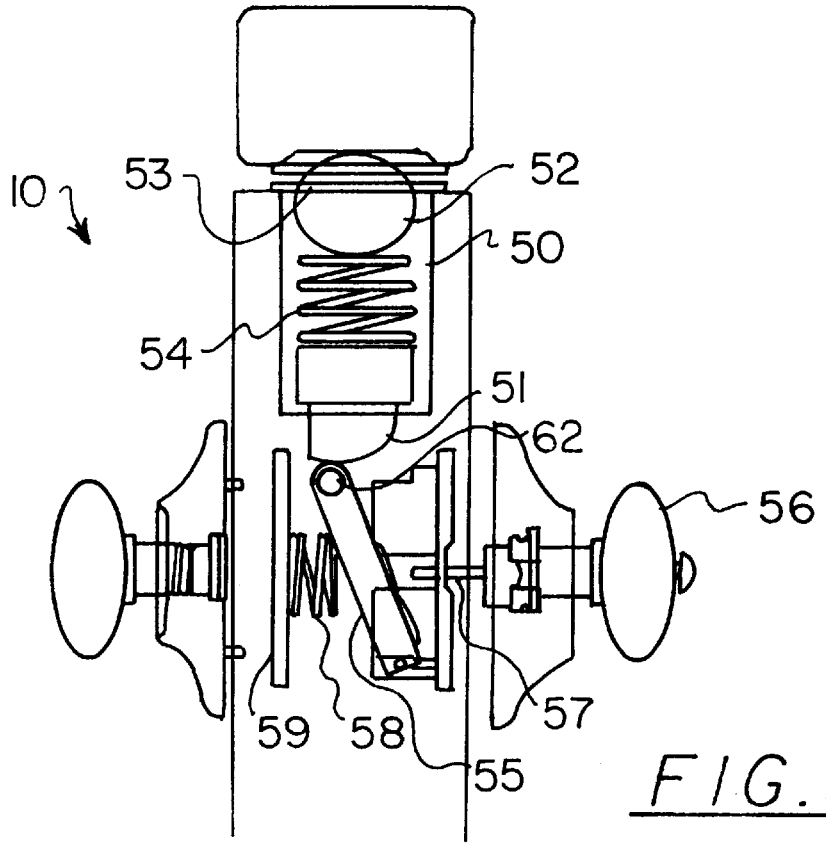
FIG. 5 is a plan view of an alternate embodiment of the present invention.
Figure 6:
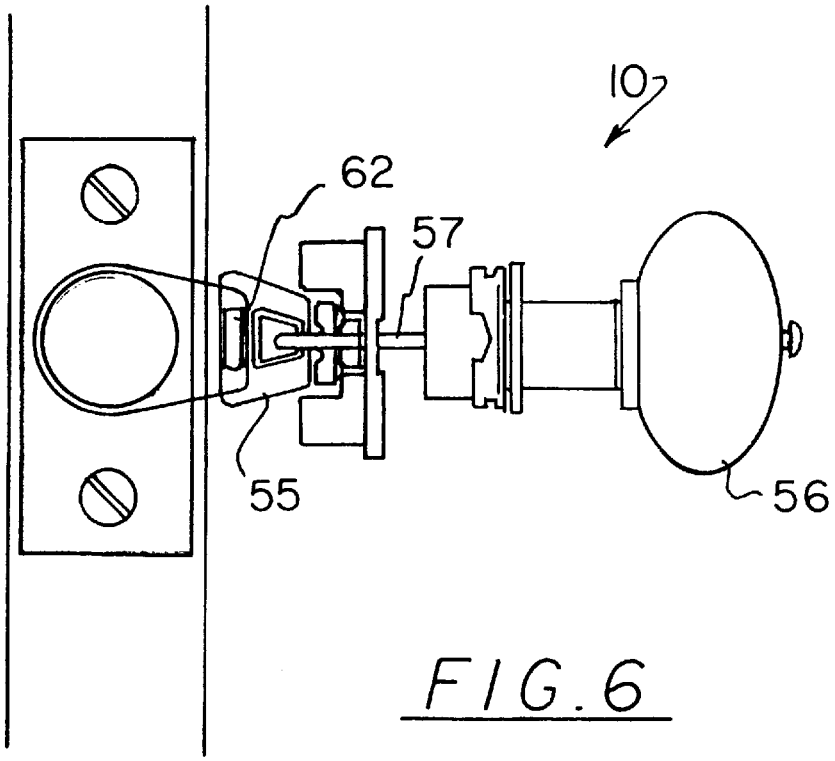
FIG. 6 is a side view of the alternate embodiment of the present invention.
Figure 7:
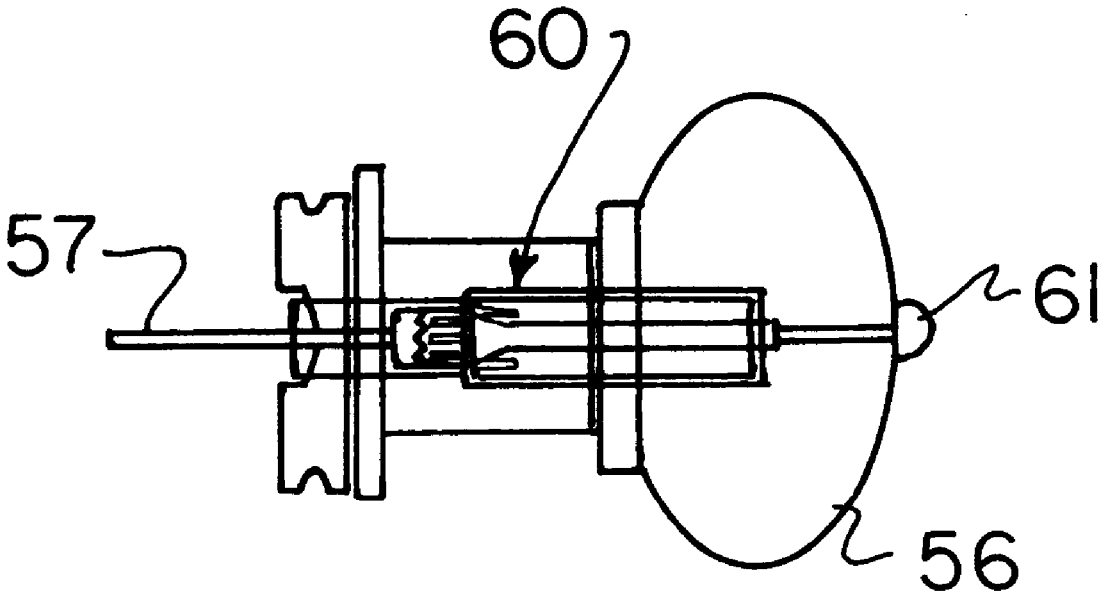
FIG. 7 is a cross sectional view of the knob of the alternate embodiment of the present invention.

In an alternate embodiment, shown in FIGS. 5 through 7, a barring casing 50 is adapted to be inserted in a door or other closure and houses a pressure block 51 at one end, a ¾ inch ball bearing 52 at the other end which is held in the barring casing by a holed barring plate 53, and a spring 54 between the pressure block and ball bearing. The ball bearing slides freely along a portion of the inside of the barring casing when the pressure block is in an unlocked position. The spring biases the ball bearing outwardly when the pressure block is in a locked position.

A pivot arm 55 is pivotally coupled in the door and is in selective engagement with the pressure block. A door knob 56 with a lock rod 57 extending from it is slidably coupled to the door. The lock rod is coupled to or engages the pivot arm such that movement of the door knob towards the door disengages the pivot arm from the pressure block, thereby releasing the ball bearing. Pulling the door knob away from the door causes the pivot arm to engage the pressure block, thereby pushing the ball bearing partially out through the barring plate where it engages a depression in the surrounding frame to lock the door or closure shut. Ideally, the pivot arm has a roller 62 on its free end that rolls along the pressure block.

Preferably, a biasing spring 58 biases the pivot arm into engagement with the pressure block. Ideally, a backing plate 59 is coupled to a free end of the biasing spring to reduce wear of the spring against the inside of the door or closure.

Also preferably, the door knob has a double press lock 60 in communication with the lock rod. See FIG. 7. The lock rod is slidably disposed in the door knob with a limited range of sliding. Pushing a button 61 of the double press lock once pushes the lock rod out of the door knob, thereby unlocking the door. Pushing the button of the double press lock again retracts the lock rod, thereby locking the door. Thus, the door may be locked and unlocked either by moving the door knob or by pushing the button.

Ideally, the double press lock operates like the mechanism of a writing instrument that selectively extends the tip of an ink cartridge in and out of a front tip of the writing instrument upon pushing a button located opposite the front tip. Such double press locks are known in the art and as such will not be discussed further.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multifunction door knob assembly for allowing for a door to be opened easily without turning a door knob comprising, in combination:

a door having a side opening extending within a side edge thereof, the door having openings through front and rear surfaces thereof in communication with the side opening;

an engagement mechanism disposed within the side opening of the door, the engagement mechanism including a cylindrical casing having open opposed ends, one of the opposed ends having a ball bearing slidably disposed therein, the ball bearing engaging a door casing in a closed orientation, opposed from the ball bearing in the opposed open end of the casing is a pressure block, the pressure block being slidably disposed within the casing, the pressure block having a pair of tabs disposed thereon to preclude disengagement from the casing, a spring disposed between interior ends of the ball bearing and the pressure block;

a swing arm disposed within the side opening of the door inwardly of the engagement mechanism, the swing arm having an outer portion and an inner portion, an inner end of the inner portion being pivotally coupled within the side opening of the door, an outer end of the outer portion having a roller ball disposed therein within a U-shaped housing, the roller ball selectively engaging an inner end of the pressure block, the inner portion being freely rotatable with respect to the outer portion, the inner portion having a coil spring coupled thereto to facilitate retractable rotation of the inner portion, the inner portion having a cord wrappedly coupled thereto;

a first door knob slidably received within the opening in the front surface of the door, the first door knob having an interior arm portion disposed within the side opening of the door, the interior arm portion positioned for selectively moving the swing arm forwardly when the first door knob is pushed inwardly with respect to the opening in the front surface of the door; and a second door knob removably positioned within the opening in the rear surface of the door, the second door knob being secured to a free end of the cord whereby outward pulling of the second door knob will pull the swing arm towards the opening in the rear surface of the door whereby releasing the second door knob will cause the coil spring to wind the cord around the spring arm and return the second door knob within the opening in the rear surface of the door, the second door knob having a stop block extending inwardly therefrom to limit movement of the swing arm.

2. A multifunction door knob assembly for allowing for a door to be opened easily without turning a door knob comprising, in combination:

an engagement mechanism disposed within a side opening of a door, the engagement mechanism including a cylindrical casing having open opposed ends, one of the opposed ends having a ball bearing slidably disposed therein, the ball bearing engaging a door casing in a closed orientation, opposed from the ball bearing in the opposed open end of the casing is a pressure block, the pressure block being slidably disposed within the casing, the pressure block having a pair of tabs disposed thereon to preclude disengagement from the casing, a spring disposed between interior ends of the ball bearing and the pressure block; and a swing arm disposed within the side opening of the door inwardly of the engagement mechanism, the swing arm having an outer portion and an inner portion, an inner end of the inner portion being pivotally coupled within the side opening of the door, an outer end of the outer portion having a roller ball disposed therein within a U-shaped housing, the roller ball selectively engaging an inner end of the pressure block, the inner portion being freely rotatable with respect to the outer portion, the inner portion having a coil spring coupled thereto to facilitate retractable rotation of the inner portion, the inner portion having a cord wrappedly coupled thereto.

3. The multifunction door knob assembly as set forth in claim 2 and further including a first door knob slidably received within the opening in the front surface of the door, the first door knob having an interior arm portion disposed within the side opening of the door, the interior arm portion positioned for selectively moving the swing arm forwardly when the first door knob is pushed inwardly with respect to the opening in the front surface of the door.

4. The multifunction door knob assembly as set forth in claim 2 and further including a second door knob removably positioned within the opening in the rear surface of the door, the second door knob being secured to a free end of the cord whereby outward pulling of the second door knob will pull the swing arm towards the opening in the rear surface of the door whereby releasing the second door knob will cause the coil spring to wind the cord around the spring arm and return the second door knob within the opening in the rear surface of the door, the second door knob having a stop block extending inwardly therefrom to limit movement of the swing arm.

* * * * *